US008330368B2

(12) United States Patent
Tsuchida et al.

(10) Patent No.: US 8,330,368 B2
(45) Date of Patent: Dec. 11, 2012

(54) PLASMA DISPLAY PANEL AND MANUFACTURING METHOD THEREOF

(75) Inventors: Shuzo Tsuchida, Nara (JP); Kazuto Fukuda, Osaka (JP); Kenji Date, Hyogo (JP)

(73) Assignee: Panasonic Corporation, Osaka (JP)

( * ) Notice: Subject to any disclaimer, the term of this patent is extended or adjusted under 35 U.S.C. 154(b) by 458 days.

(21) Appl. No.: 12/615,522

(22) Filed: Nov. 10, 2009

(65) Prior Publication Data

US 2010/0134006 A1 Jun. 3, 2010

(30) Foreign Application Priority Data

Dec. 2, 2008 (JP) ..... 2008-307180

(51) Int. Cl.
*H01J 17/49* (2006.01)

(52) U.S. Cl. ..... 313/586; 313/582; 313/587

(58) Field of Classification Search ..... 313/582–587
See application file for complete search history.

(56) References Cited

U.S. PATENT DOCUMENTS

| | | | | |
|---|---|---|---|---|
| 6,600,265 | B1 | 7/2003 | Ebihara et al. | |
| 2009/0058296 | A1 * | 3/2009 | Uriu et al. | 313/582 |
| 2011/0221338 | A1 * | 9/2011 | Tsuchida | 313/582 |

FOREIGN PATENT DOCUMENTS

| | | | |
|---|---|---|---|
| JP | 2000-30617 | | 1/2000 |
| JP | 2005-108691 | | 4/2005 |
| JP | 2008-27862 | | 2/2008 |
| WO | 02/31853 | | 4/2002 |
| WO | WO 2007105468 | A1 * | 9/2007 |
| WO | WO 2009101666 | A1 * | 8/2009 |

* cited by examiner

*Primary Examiner* — Anne Hines
*Assistant Examiner* — Jose M Diaz
(74) *Attorney, Agent, or Firm* — Wenderoth, Lind & Ponack, L.L.P.

(57) ABSTRACT

An object of the present invention is to provide a plasma display panel that can suppress the generation of cracks in a dielectric layer, and also improve the yield, and a method for manufacturing such a display panel. A dielectric layer on a front panel is designed to have a two-layer structure in which a first dielectric layer and a second dielectric layer are laminated, and the first dielectric layer is formed through processes in which, after printing or applying a dielectric paste containing a glass frit onto a front substrate so as to cover display electrodes formed thereon as a stripe pattern, drying and firing the resulting substrate at a temperature not less than a softening point of the glass frit, and the second dielectric layer is formed on the first dielectric layer by using a sol-gel method.

2 Claims, 4 Drawing Sheets

PLASMA DISPLAY PANEL AND MANUFACTURING METHOD THEREOF

BACKGROUND OF THE INVENTION

The present invention relates to a plasma display panel for use in an image display device and the like and a manufacturing method thereof. More specifically, the present invention relates to a structure of a dielectric layer of a front panel installed in the plasma display panel and a manufacturing method thereof.

Since the plasma display panel (hereinafter, referred to as a "PDP") is capable of achieving high definition and a large-size screen, it has been used for a large-size television or the like, for example, having a size of 65 inches or more. In recent years, the PDP's have been progressively applied to a high-definition television having scanning lines of two times or more than those of a conventionally known television of the NTSC system, and there has been a strong demand for their lower power consumption.

The PDP is provided with a front panel and a back panel in its basic structure. The front panel is usually provided with a front substrate, display electrodes formed on one surface of the front substrate as a stripe pattern, a dielectric layer that covers the display electrodes and serves as a capacitor, and a dielectric-protection layer formed on the dielectric layer. On the other hand, the back panel is provided with a back substrate, address electrodes formed on one surface of the back substrate as a stripe pattern, and an base dielectric layer that covers the address electrodes. On the base dielectric layer, a plurality of barrier ribs are formed as a stripe pattern. These barrier ribs are made in parallel with the address electrodes, and when viewed in a thickness direction of the back panel, these are disposed so that each address electrode is positioned between the adjacent barrier ribs. Phosphor layers that respectively emit red, green, and blue-colored light rays are successively formed in grooves, each formed among side walls of the adjacent barrier ribs and the base dielectric layer.

The PDP has a tightly-sealed structure in which the front panel and the back panel are disposed with their faces on which electrodes (display electrodes and address electrodes) are formed being opposed to each other, with their peripheral portions being sealed with a sealing member. In this tightly-sealed space formed by this tightly-sealed structure, a discharge gas such as neon (Ne) or xenon (Xe) is sealed with a pressure in a range of 53,000 Pa to 80,000 Pa, so as to form a discharge space. The PDP selectively applies an image signal voltage to the display electrode so that a gas discharge is generated in the discharge space, and ultraviolet rays, generated by the gas discharge, are allowed to excite the phosphor layers with the respective colors so as to emit visible light rays so that a color image is displayed.

In the PDP constructed as described above, the dielectric layer on the front panel is generally formed through processes in which, after a dielectric paste having glass frits of several micrometers is printed or applied onto one of the surfaces of the front substrate so as to cover the display electrode, the substrate is dried and fired at a temperature that is the softening point of the glass frit or more. Hereinafter, this method for forming a dielectric layer is referred to as a firing method.

On the other hand, it has been known that, in order to reduce the power consumption of the PDP, it is effective to reduce the dielectric constant of the dielectric layer of the front panel. In the above-mentioned firing method, however, since the glass frit needs to be fused at a low temperature, a glass material having a low melting point needs to be used. This glass material having a low melting point is poor in purity and has a dielectric constant as high as 10 or more. For this reason, the dielectric constant of the dielectric layer tends to be higher as a result.

As a method for lowering the dielectric constant of the dielectric layer, a method for forming the dielectric layer by using a sol-gel method is proposed. In this method, after a silicon compound is obtained by subjecting a metal alkoxide in a solvent to hydrolysis, the compound is heated to be subjected to a condensation polymerization reaction so that a dielectric layer mainly formed of silicon oxide is formed. In this method, since the glass frit needs not be fused, the dielectric layer can be formed at a low temperature so that this method is effective also from the viewpoint of production costs.

Moreover, as another method for lowering the dielectric constant of the dielectric layer, Patent Document 1 (JP 2008-27862 A) has proposed the following method. Patent Document 1 discloses the method in which the dielectric layer of the front panel is designed to have a two-layer structure having a fine particle layer and an insulating layer.

In the method for forming the dielectric layer by using the sol-gel method, however, cracks might be generated in the dielectric layer due to foreign matters that have given no adverse effects in the method for forming the dielectric layer by the firing method and irregularities on the display electrode or the like. In the case when a voltage is applied to the display electrode with cracks formed in the dielectric layer, defects such as a spark might be generated.

Moreover, in Patent Document 1, the fine particle layer has a structure in which silica fine particles are aggregated. That is, the fine particle layer is a porous layer with voids among the silica fine particles. For this reason, the porous layer is poor in adhesive property and strength, and upon forming an insulating layer on the fine particle layer, the porous layer tends to be easily separated by a stress given by the insulating layer. That is, the structure of Patent Document 1 raises an issue that the yield becomes poor. Moreover, it is difficult to ensure a uniform distribution of the voids, which causes another issue in which luminance irregularities tend to occur in the PDP.

Therefore, the present invention has been devised to improve the issues, and an object thereof is to provide a plasma display panel that can suppress generation of cracks in the dielectric layer, and also improve the yield, and a method for manufacturing such a panel.

SUMMARY OF THE INVENTION

In order to achieve the above-mentioned object, the present invention has the following structures.

According to a first aspect of the present invention, there is provided a method for manufacturing a plasma display panel, the plasma display including a front panel and a back panel placed to be opposed to each other with a discharge space formed therebetween, with the space being sealed with an adhesive sealing member disposed on a non-image display area on a peripheral portion of the space, the method comprising:

forming a first dielectric; and forming a second dielectric layer on the first dielectric layer by using a sol-gel method, wherein the forming a first dielectric layer comprises, printing or applying a dielectric paste containing a glass frit onto a front substrate to cover display electrodes formed thereon as a stripe pattern, drying the printed or applied dielectric paste, and firing the dried dielectric paste at a temperature not less than a softening point of the glass frit. According to a second aspect of the present invention, there is provided the method for manufacturing a plasma display panel according to the first aspect, wherein the second dielectric layer is formed on the first dielectric layer to allow an edge portion of the first dielectric layer to be exposed on a plan view, and wherein the adhesive sealing member is formed to be made in contact with the edge portion of the first dielectric layer, without being made in contact with the second dielectric layer.

According to a third aspect of the present invention, there is provided a plasma display panel comprising:

a front panel and a back panel placed to be opposed to each other with a discharge space formed therebetween, with the space being sealed with an adhesive sealing member disposed on a non-image display area on the peripheral portion of the space, wherein the front panel is provided with a first dielectric layer and a second dielectric layer, the first dielectric layer being formed onto a front substrate to cover display electrodes formed thereon as a stripe pattern and containing low-melting-point glass having a softening point in a range of 400° C. or more to 600° C. or less, and the second dielectric layer having a structure with a siloxane skeleton that is formed on the first dielectric layer.

According to a fourth aspect of the present invention, there is provided the plasma display panel according to the third aspect, wherein the second dielectric layer is formed on the first dielectric layer to allow an edge portion of the first dielectric layer to be exposed on a plan view, and wherein the adhesive sealing member is formed to be made in contact with the edge portion of the first dielectric layer, without being made in contact with the second dielectric layer.

According to the method for manufacturing a plasma display panel of the present invention, since the first dielectric layer is formed by using a so-called firing method and the second dielectric layer is formed by using the sol-gel method, the first dielectric layer makes it possible to suppress the generation of cracks in the dielectric layers due to foreign matters and irregularities on the display electrode. Moreover, the second dielectric layer makes it possible to achieve a reduced dielectric constant of the entire dielectric layers. Moreover, since the second dielectric layer is not a porous layer like that of Patent Document 1, there is no possibility of a reduction in the adhesive property and strength as well as luminance irregularities in the PDP. Furthermore, in the case of forming the first dielectric layer by using the glass-frit-containing material through the firing method, although the glass frit is fused, a concave/convex pattern is formed on the surface of the first dielectric layer by the trace of its shape. This concave/convex pattern on the surface of the first dielectric layer presumably provides an anchor effect upon forming the second dielectric layer to improve the adhesive strength between the first dielectric layer and the second dielectric layer. Therefore, according to the method for manufacturing a plasma display panel of the present invention, it becomes possible to suppress defective separation and consequently to improve the yield.

Moreover, according to the plasma display panel of the present invention, the dielectric layer has a two-layer structure of the first dielectric layer containing the low-melting-point glass having a softening point in a range of 400° C. or more to 600° C. or less and the second dielectric layer having a structure with a siloxane skeleton. That is, in the plasma display panel according to the present invention, since the first dielectric layer is formed by using the firing method and the second dielectric layer is formed by using the sol-gel method, it is possible to suppress the generation of cracks in the dielectric layer and also to improve the yield as described above.

BRIEF DESCRIPTION OF THE DRAWINGS

These and other aspects and features of the present invention will become clear from the following description taken in conjunction with the preferred embodiments thereof with reference to the accompanying drawings, in which.

DETAILED DESCRIPTION OF THE PREFERRED EMBODIMENTS

Figure 1:
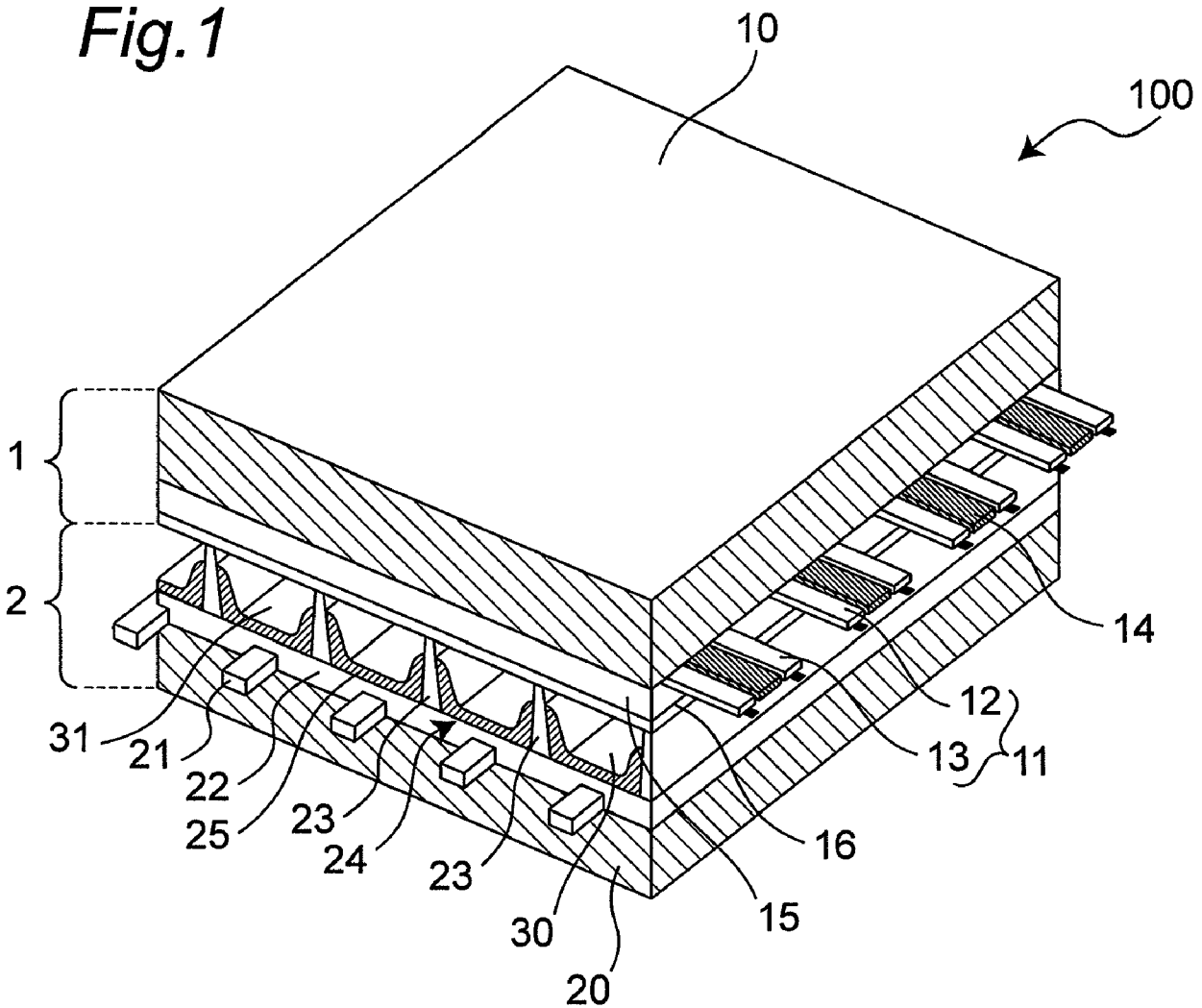
FIG. 1 is a perspective view that schematically shows a basic structure of a PDP in accordance with an embodiment of the present invention.

Before the description of the present invention proceeds, it is to be noted that like parts are designated by like reference numerals throughout the accompanying drawings.

Hereinbelow, one embodiment of the present invention is described in detail with reference to the accompanying drawings.

Embodiment

Referring to FIG. 1, the following description will discuss a basic structure of a PDP in accordance with an embodiment of the present invention. FIG. 1 is a perspective view that schematically shows a basic structure of the PDP in accordance with the embodiment of the present invention. The basic structure of the PDP of the present embodiment is the same as the structure of a generally-used AC surface discharge type PDP.

In FIG. 1, a PDP 100 in accordance with the present embodiment is provided with a front panel 1 and a back panel 2 disposed so as to be opposed to the front panel 1. An adhesive sealing member 17 (see FIG. 3) made of a sealing glass frit or the like is placed on a periphery of a space between the front panel 1 and the back panel 2. The PDP 100 is air-tightly sealed with the sealing member 17 so that a discharge space 30 is formed inside the PDP 100. In the discharge space 30, a discharge gas such as neon (Ne) or xenon (Xe) is sealed with a pressure from 53,000 Pa to 80,000 Pa.

The front panel 1 is provided with a front substrate 10 made of glass or the like. A pair of stripe-shaped display electrodes 11 provided with a scanning electrode 12 and a sustaining electrode 13, and a black stripe (referred to also as a light-shielding layer) 14 are disposed on one surface of the front substrate 10 as a plurality of layers in parallel with one another. Moreover, on the surface of the front substrate 10, a dielectric layer 15 is formed so as to cover each of the display electrode 11 and the light-shielding layer 14. With this structure, the dielectric layer 15 serves as a capacitor. A dielectric-protection layer 16 is formed on the dielectric layer 15 so as to cover the dielectric layer 15 for protecting the electrodes.

A back substrate 20, made of glass or the like, is formed on the back panel 2. On one surface of the back substrate 20, a plurality of stripe-shaped address electrodes 21 are disposed so as to orthogonally intersect with the respective display electrodes 11, in parallel with one another. Moreover, on the surface of the back substrate 20, a base dielectric layer 22 is formed so as to cover the respective address electrodes 21. On the base dielectric layer 22, a plurality of barrier ribs 23 having a predetermined height are disposed in parallel with an extending direction of the address electrodes 21, so as to divide the discharge space 30 for each of the address electrodes 21. In each groove portion 24 formed by the side faces of the adjacent barrier ribs 23 and the base dielectric layer 22, phosphor layers 25 that respectively emit red, blue, and green light rays upon irradiation with ultraviolet rays are successively formed.

With the above-mentioned structure, a discharge cell 31 is formed on each of intersecting portions at which the display electrode 11 and the address electrode 21 are intersect with each other. That is, the discharge cells 31 are disposed in a matrix format. These discharge cells 31 form an image display area of the PDP 100, and three discharge cells 31 respectively having the red-color, blue-color, and green-color phosphor layers 25, aligned in the extending direction of the display electrodes 11, serve as pixels for color display.

When various driving signals are successively applied between the scanning electrode 12 and the address electrode 21 as well as between the scanning electrode 12 and the sustaining electrode 13 from, for example, an external driving circuit placed outside the PDP 100, a gas discharge is generated in each of the discharge cells 31 so that ultraviolet rays are generated by the gas discharge. In the PDP 100, by allowing the ultraviolet rays generated in each of the display cells 31 to excite the phosphor layer 25 corresponding to each of the discharge cells 31 so that visible light rays are emitted; thus, a color displaying process can be carried out.

Figure 2:
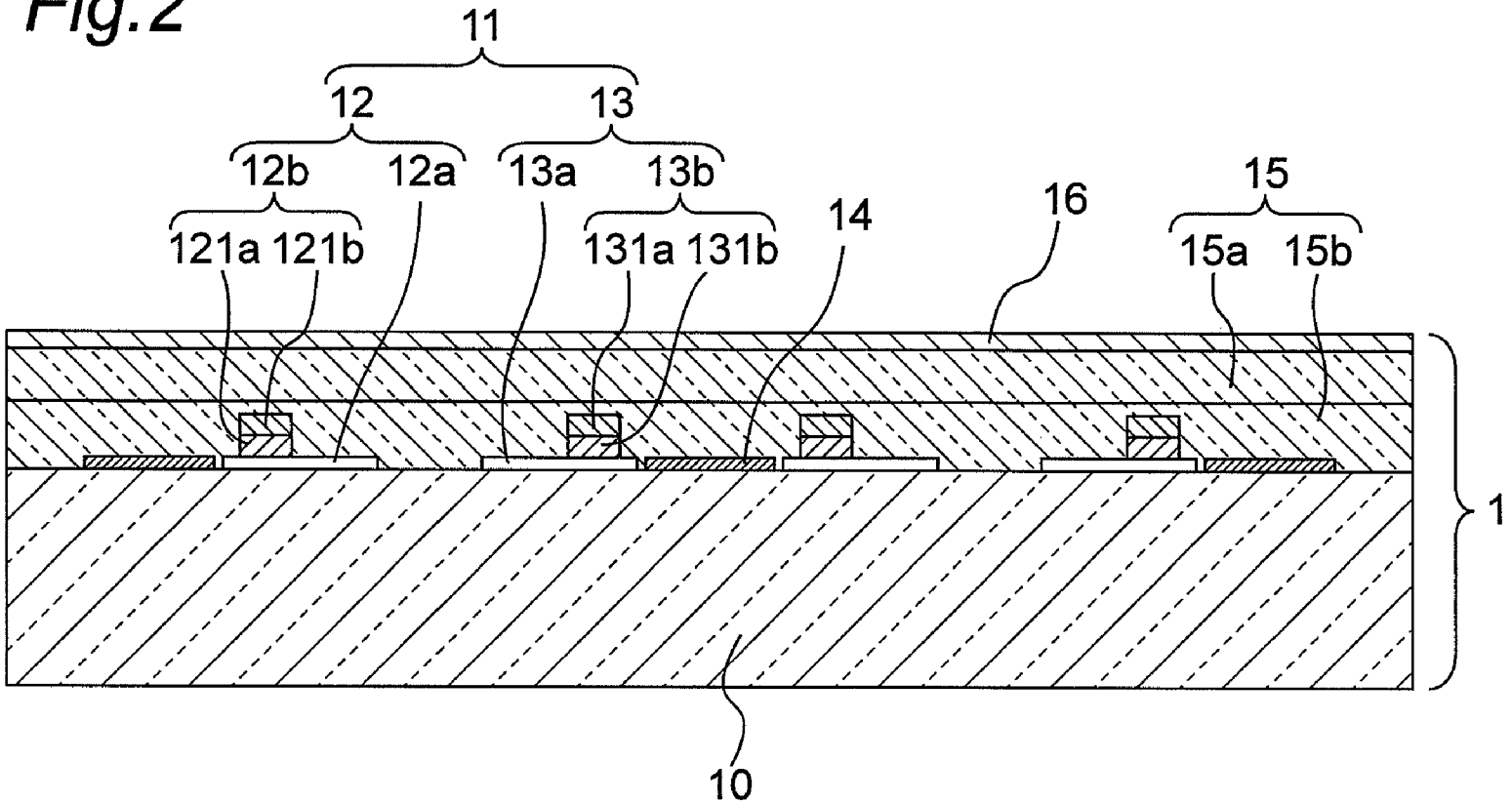
FIG. 2 is a cross-sectional view that schematically shows a basic structure of a front panel installed in the PDP in accordance with the embodiment of the present invention.
Figure 3:
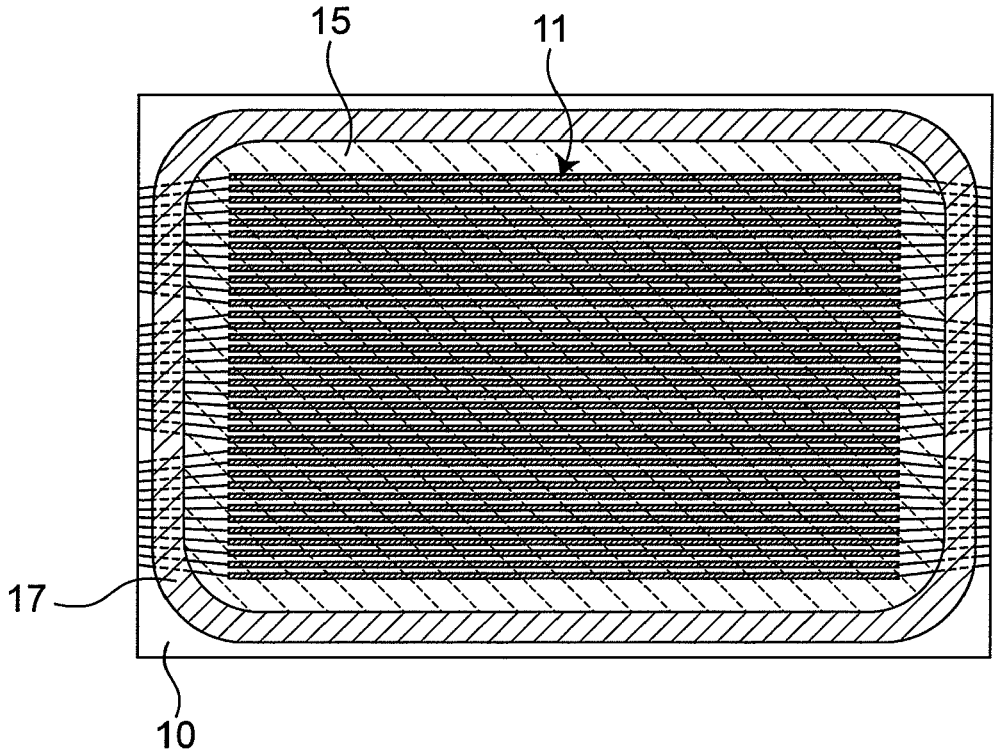
FIG. 3 is a plan view that shows a state in which a sealing member is disposed on a periphery of an edge portion of a dielectric layer on the front panel installed in the PDP in accordance with the embodiment of the present invention.

Next, referring to FIGS. 2 and 3, the following description will discuss the structure of the front panel 1 in more detail. FIG. 2 is a cross-sectional view that shows a basic structure of the front panel 1. In FIG. 2, the layout of the front panel 1 is shown upside down in a manner reversed to that of FIG. 1. FIG. 3 is a plan view that shows a state in which the sealing member 17 is disposed so as to cover the peripheral edge portion of the dielectric layer 15 of the front panel 1.

In FIG. 2, the front substrate 10 is formed of a glass member such as sodium borosilicate-based glass by using, for example, a float method. On the front substrate 10, the display electrode 11, provided with the scanning electrode 12 and the sustaining electrode 13, and the black stripe 14 are pattern-formed. Each of the scanning electrode 12 and the sustaining electrode 13 is provided with transparent electrodes 12*a* and 13*a* and metal bus electrodes 12*b* and 13*b* formed on the corresponding transparent electrodes 12*a* and 13*a*. Each of the transparent electrodes 12*a* and 13*a* is formed of indium tin oxide (ITO), zinc oxide ($SnO_2$) or the like. The metal bus electrodes 12*b* and 13*b* are used for the purpose of applying a conductive property to the transparent electrodes 12*a* and 13*a* in its longitudinal direction, and made from a conductive material mainly formed of a silver (Ag) material. Moreover, the metal bus electrodes 12*b* and 13*b* are respectively provided with black-colored electrodes 121*b* and 131*b* and white-colored electrodes 121*b* and 131*b*. In the above-mentioned structure, each of the scanning electrode 12 and the sustaining electrode 13 is provided with the transparent electrodes 12*a* and 13*a* and the metal bus electrodes 12*b* and 13*b*; however, the transparent electrodes 12*a* and 13*a* are not necessarily required, and these may be provided only with the metal bus electrodes 12*b* and 13*b*.

Moreover, on the front substrate 10, the dielectric layer 15 is formed so as to respectively cover the transparent electrodes 12*a* and 13*a*, the metal bus electrodes 12*b* and 13*b*, and the black stripe 14. The dielectric layer 15 has a two-layer structure in which a first dielectric layer 15*a* to be placed on the front substrate 10 side and a second dielectric layer 15*b* to be placed on the first dielectric layer 15*a* are laminated. As will be described later in detail, the first dielectric layer 15*a* is formed by a firing method, and formed of low-melting-point glass having a softening point in a range of 400° C. or more to 600° C. or less. As will be described later in detail, the second dielectric layer 15*b* is formed by a sol-gel method, and has a structure with a siloxane skeleton in which an alkyl group is combined with silicon. The first dielectric layer 15*a* and the second dielectric layer 15*b* are both disposed over the entire image display area, and their edge portions are positioned on a non-image display area.

The dielectric-protection layer 16 is formed on the second dielectric layer 15*b*. The dielectric-protection layer 16 is made from, for example, magnesium oxide (MgO) or the like.

When the front panel 1 having the above-mentioned structure is joined to the back panel 2, the sealing member 17 is disposed on the periphery of the edge portion of the dielectric layer 15 in the non-image display area, as shown in FIG. 3. A desirable positional relationship among the first dielectric layer 15*a*, the second dielectric layer 15*b*, and the sealing member 17 will be described later in detail.

Next, referring to FIGS. 1 to 3, the following description will discuss a method for manufacturing the PDP 100 based upon specific examples.

First, the following description will discuss a method for manufacturing the front panel 1.

First, the stripe-shaped display electrode 11 provided with the scanning electrode 12 and the sustaining electrode 13, and the black stripe 14 are formed on the front substrate 10.

More specifically, as shown in FIG. 2, the transparent electrodes 12*a* and 13*a* and the black stripe 14 are formed on the front substrate 10. Thereafter, the metal bus electrodes 12*b* and 13*b* are formed on respective portions of the transparent electrodes 12*a* and 13*a*. Thus, the display electrode 11 provided with the scanning electrode 12 and the sustaining electrode 13, and the black stripe 14 are formed.

The transparent electrodes 12*a* and 13*a* and the metal bus electrodes 12*b* and 13*b* are formed through a patterning process by using a photolithography method or the like. The transparent electrodes 12*a* and 13*a* are formed by patterning films, formed by a thin-filming process or the like, by using a photolithography method. The metal bus electrodes 12*b* and 13*b* and the black stripe are formed by patterning films, made from a paste containing conductive particles and a black pigment, by using the photolithography method and then firing the films at a desired temperature so as to be solidified.

More specifically, the following sequence of processes is generally used for forming the metal bus electrodes 12*b* and 13*b* and the black stripe 14.

A paste containing a black pigment or the like is printed on the front substrate 10, on which the transparent electrodes 12*a* and 13*a* have been preliminarily formed, by using a screen printing method or the like, and dried thereon. Thereafter, the dried paste is patterned by a photolithography method so that the black stripe 14 is formed thereon. Next, a paste containing a black pigment, conductive particles, and the like, to be formed into a black-colored electrode, is printed thereon in the same manner, by using the screen printing method, and dried thereon. On this is further printed a paste containing conductive particles or the like (for example, silver (Ag) or platinum (Pt)) to be formed into a white-colored electrode, by using a screen printing method or the like, and dried thereon. Successively, by patterning this by using the photolithography method, the metal bus electrodes 12*b* and 13*b*, provided with the black-colored electrodes 121*b* and 131*b* and the white-colored electrodes 121*a* and 131*a*, are formed. In this case, in order to improve the contrast upon displaying an image, the black-colored electrodes 121*b* and 131*b* are formed as lower layers (on the front substrate 10 side) and the white-colored electrodes 121*a* and 131*a* are formed as upper layers.

Additionally, the black stripe 14 may be formed by using the same materials as those of the black-colored electrodes 121*b* and 131*b* of the metal bus electrodes 12*b* and 13*b*. In this case, however, since the black stripe 14 is allowed to contain a conductive material, it is necessary to take it into consideration that an erroneous discharge or the like might be generated upon displaying an image.

Next, the first dielectric layer 15*a* is formed on the front substrate 1 by using a firing method so as to cover the display electrode 11 and the black stripe 14.

More specifically, a dielectric paste containing a glass frit and a binder, to be formed into the first dielectric layer 15*a*, is applied onto the front substrate 10 by using a die coating method in which a coating process is carried out, for example, by discharging a paint or a solution through a slit die, and the paste is left standing for a predetermined period of time. Thus, the surface of the coated dielectric paste is leveled to form a flat surface. Thereafter, the dielectric paste layer is dried and fired so as to be solidified; thus, the first dielectric layer 15*a* is formed.

Here, by repeating the coating process of the first dielectric paste a plurality of times, it becomes possible to form the first dielectric layer 15*a* having a desired film thickness.

Next, the second dielectric layer 15*b* is formed on the first dielectric layer 15*a* by using a sol-gel method.

More specifically, a sol to be formed into the second dielectric layer 15*b* is diluted with a solvent such as alcohol, and the diluted solution is applied onto the first dielectric layer 15*a* by using a die coating method or the like. Thereafter, the applied sol is left standing for a predetermined period of time. Thus, the surface of the applied sol is leveled to form a flat surface, and the sol is solidified through reactions of hydrolysis and polycondensation so that a gel is formed. Thereafter, the gel is heated so that the second dielectric layer 15*b* is formed.

As the sol, for example, a sol having a structure with a siloxane skeleton in which an alkyl group is combined with silicon may be used. Moreover, by repeating the coating and drying process of the sol a plurality of times, it becomes possible to form the second dielectric layer 15*b* having a desired film thickness. The sol may be used with a glass frit or a solvent being mixed therein as necessary for adjusting the film thickness and the viscosity.

Next, the dielectric-protection layer 16 is formed on the second dielectric layer 15*b* by using, for example, a vacuum vapor deposition method.

By using the above-mentioned processes, the front panel 1 having predetermined component members on the front substrate 10 is completed.

The following description will discuss a method for manufacturing the back panel 2.

First, by using a method in which a paste containing a silver (Ag) material is screen-printed or a method in which, after a metal film is formed on the entire surface, a patterning process is carried out by using a photolithography method, a material layer forming a component member for the address electrode 21 is formed on the back substrate 20. Thereafter, the material layer is fired at a desired temperature so that the address electrode 21 is formed.

Next, on the back substrate 20 with the address electrode 21 formed thereon, an base dielectric paste is applied by a die coating method or the like so as to cover the address electrode 21 so that an base dielectric paste layer is formed. Thereafter, by baking the base dielectric paste layer, an base dielectric layer 22 is formed. The base dielectric paste is a paint containing a dielectric material such as a glass frit, a binder, and a solvent.

Next, a barrier rib-forming paste containing a material for the barrier rib is applied to the base dielectric layer 22, and by patterning this into a predetermined shape, a barrier-rib-material layer is formed. Thereafter, by firing the barrier-rib-material layer, the barrier ribs 23 are formed. As the method for patterning the barrier-rib-forming paste applied onto the base dielectric layer 22, a photolithography method or a sand blasting method may be used.

Next, a phosphor paste containing a phosphor material is applied to the groove portion 24 between the mutually adjacent barrier ribs 23 so that a phosphor paste layer is formed. Thereafter, by baking the phosphor paste layer, the phosphor layer 25 is formed.

By using the above-mentioned processes, the back panel 2 having predetermined component members on the back substrate 20 is completed.

The front panel 1 and the back panel 2 that have predetermined component members as described above are disposed so as to be opposed to each other, with the scanning electrodes 12 and the address electrodes 21 being orthogonal to each other, with the peripheral portion being sealed with the sealing member 17. Thus, the discharge space 30 is formed. Thereafter, a discharge gas containing neon (Ne), xenon (Xe), or the like is sealed into the discharge space 30. Thus, the PDP 100 is completed.

The following description will discuss a method for forming the metal bus electrodes 12*b* and 13*b* of the front panel 1 in detail by reference to specific examples.

First, a glass material having the following material composition is prepared as the material for the black-colored electrodes 121*b* and 131*b*. The glass material is basically formed of bismuth oxide ($Bi_2O_3$) (15 to 40% by weight), silicon oxide ($SiO_2$) (3 to 20% by weight), and boron oxide ($B_2O_3$) (10 to 45% by weight), and contains an additive such as a transition metal used for adjusting the softening point, the color of the electrode, and the like. Additionally, in the case when the content is too high depending on the rate of the glass material, since there is a possibility that the glass-forming process is not carried out uniformly, it is effective to adjust the content depending on the circumstance.

Next, the glass material formed of the above-mentioned composition components is pulverized with a wet jet mill or a ball mill so that the average particle size is set to 0.5 μm to 2.5 μm; thus, an electrode glass powder is prepared. Next, the electrode glass powder (15 to 30% by weight), a binder component (10 to 45% by weight), and a black pigment (5 to 15% by weight) are kneaded sufficiently with a triple roll so that an electrode paste for die coating or printing is prepared.

In this case, the binder component is ethylene glycol containing acrylic resin (5 to 25% by weight) that further contains 5% by weight or less of a photosensitive initiator. Moreover, to the paste, dioctyl phthalate, dibutyl phthalate, triphenyl phosphate, or tributyl phosphate may be added as a plasticizer, if necessary, and glycerol monoolate, sorbitan sesquioleate, Homogenol (trade name of Kao Corp.: registered trademark) or phosphate of alkyl-allyl group may also be added as a dispersant so as to improve the printing property.

On the other hand, a glass material having the following material composition is prepared as the material for the white-colored electrodes 121*a* and 131*a*. The glass material is basically formed of bismuth oxide ($Bi_2O_3$) (15 to 40% by weight), silicon oxide ($SiO_2$) (3 to 20% by weight), and boron oxide ($B_2O_3$) (10 to 45% by weight), and contains a transition metal, such as Ag, Pt, or Au, as a conductive material, so as to ensure the conductivity. Additionally, in the case when the content of the glass material is too high, since there is a possibility that the glass-forming process is not carried out uniformly, it is effective to properly adjust the content depending on the circumstance.

Next, in the same manner as in the black-colored electrodes 121*b* and 131*b*, the glass material formed of the above-mentioned composition components is pulverized with a wet jet mill or a ball mill so that the average particle size is set to 0.5 μm to 2.5 μm; thus, an electrode glass powder is prepared. Next, the electrode glass powder (0.5 to 20% by weight), a binder component (1 to 20% by weight), and conductive particles such as Ag or Pt (50 to 85% by weight) are kneaded sufficiently with a triple roll so that an electrode paste for die coating or printing is prepared.

In this case, the binder component is ethylene glycol containing acrylic resin (1 to 20% by weight) that further contains 5% by weight or less of a photosensitive initiator. Moreover, to the electrode paste, dioctyl phthalate, dibutyl phthalate, triphenyl phosphate, or tributyl phosphate may be added as a plasticizer, if necessary, and glycerol monoolate, sorbitan sesquioleate, Homogenol (trade name of Kao Corp.: registered trademark), or phosphate of alkyl-allyl group may also be added as a dispersant so as to improve the printing property.

Next, the respective electrode pastes prepared as described above are printed on the front substrate 10 by using a die coating method or a screen printing method, and dried thereon. Thereafter, a predetermined area of these is exposed to light with a quantity of light in a range of 50 to 500 mj/$cm^2$ by using an exposing mask. Thereafter, these are developed with an alkali solution, for example, one having a concentration of 0.1 to 10% by weight so that the shapes of the metal bus electrodes 12*b* and 13*b* are patterned. Thus, the metal bus electrodes 12*b* and 13*b* are formed.

In the case when the black stripe 14 is formed by using the same material as that of the black-colored electrodes 121*b* and 131*b*, the black stripe 14 can be patterned in the same manner.

The following description will discuss a method for forming the first dielectric layer 15*a* and the second dielectric layer 15*b* that constitute the dielectric layer 15 of the front panel 1 in detail by reference to specific examples.

First, a dielectric material having the following material composition is prepared as a material for the first dielectric layer 15*a*. In this case, the dielectric material is a low-melting-point glass material having a softening point in a range of 400° C. or more to 600° C. or less.

The dielectric material contains bismuth oxide ($Bi_2O_3$) (5 to 40% by weight) and calcium oxide (CaO) (0.5 to 15% by weight). Moreover, the dielectric material further contains at least one member selected from the group consisting of molybdenum oxide ($MoO_3$), tungsten oxide ($WO_3$), cerium oxide ($CeO_2$), and manganese oxide ($MnO_2$) in a range of 0.1 to 7% by weight. Furthermore, the dielectric material contains at least one member selected from the group consisting of strontium oxide (SrO) and barium oxide (BaO) in a range of 0.5 to 12% by weight.

In this case, in place of molybdenum oxide ($MoO_3$), tungsten oxide ($WO_3$), cerium oxide ($CeO_2$), and manganese oxide ($MnO_2$), the dielectric material may contain at least one member selected from the group consisting of copper oxide (CuO), chromium oxide ($Cr_2O_3$), cobalt oxide ($Co_2O_3$), vanadium oxide ($V_2O_7$), and antimony oxide ($Sb_2O_3$) in a range of 0.1 to 7% by weight.

Moreover, as components other than those described above, the dielectric material may contain materials, such as zinc oxide (ZnO) (0 to 40% by weight), boron oxide ($B_2O_3$) (0 to 35% by weight), silicon oxide ($SiO_2$) (0 to 15% by weight), and aluminum oxide ($Al_2O_3$) (0 to 10% by weight). The contents of these materials are not particularly limited. Furthermore, the dielectric material needs not contain a lead component.

Next, the dielectric material having the above-mentioned material composition is pulverized with a wet jet mill or a ball mill so that the average particle size is set to 0.5 μm to 2.5 μm; thus, a dielectric material powder is prepared. Next, the dielectric material powder (55 to 70% by weight) and a binder component (30 to 45% by weight) are kneaded sufficiently with a triple roll so that a dielectric paste for die coating or printing is prepared.

In this case, the binder component is ethylcellulose, terpineol containing acrylic resin (1 to 20% by weight), or butylcarbitol acetate. Moreover, to the dielectric paste, dioctyl phthalate, dibutyl phthalate, triphenyl phosphate, or tributyl phosphate may be added as a plasticizer, if necessary, and glycerol monoolate, sorbitan sesquioleate, Homogenol (trade name of Kao Corp.: registered trademark), or phosphate of alkyl-allyl group may also be added as a dispersant so as to improve the printing property.

Next, the dielectric paste prepared as described above is applied to, or printed on the front substrate 10 by using a die coating method or a screen printing method so as to cover the display electrode 11 and the black stripe 14. Thereafter, the coated or printed dielectric paste is dried at a temperature in a range of 60 to 200° C. Then, the dried dielectric paste is fired at a temperature of a softening temperature (400° C. to 600° C.) of the dielectric material or more. Thus, the first dielectric layer 15*a* is formed.

Next, a sol-containing solution, made by diluting a sol that is a colloidal solution made from a silicon-based alkoxide by using a solvent such as water or alcohol, is prepared as a material for the second dielectric layer 15*b*.

The shrinkage factor indicated by the dried film thickness/the applied film thickness is determined by the concentration of the alkoxide in the sol-containing solution. That is, by adjusting the concentration of the alkoxide, it is possible to control the film thickness of the second dielectric layer 15*b*. The adjustment of the concentration of the alkoxide can be carried out by adjusting the amount of the solvent to be used for diluting. Additionally, when the concentration of the alkoxide is too low, the viscosity of the sol-containing solution is lowered. For this reason, it becomes difficult to control the film thickness of the second dielectric layer 15*b*. In contrast, when the concentration of the alkoxide is too high, the alkoxide itself is easily subjected to a condensation reaction. For this reason, for example, in the case when the sol-containing solution is put into a solution tank of a coating device, the condensation reaction of the alkoxide might progress inside the solution tank of the coating device, making it difficult to control the film thickness of the second dielectric layer 15*b*.

Moreover, by adding fine particles of silicon oxide ($SiO_2$) or the like to the sol-containing solution, the shrinkage due to the condensation reaction of the alkoxide can be suppressed so that the stress alleviation and an increase in the film thickness of the second dielectric layer 15*b* can be realized. The fine particles to be added are preferably set to have a volume ratio in a range of 5 to 80%. In the case when the volume ratio of the fine particles is less than 5%, the effect of alleviating the stress becomes smaller, while when the volume ratio of the fine particles is more than 80%, the transmittance in the dielectric layer is lowered. Moreover, the average particle size of the fine particles is preferably set to 10 nm to 100 nm. In the case when the average particle size of the fine particles is less than 10 nm, the fine particles are easily aggregated, while in the case when the average particle size of the fine particles is more than 100 nm, the precipitation speed of the fine particles may become faster, failing to obtain a stable quality as the dielectric layer.

Moreover, as the above-mentioned alkoxide, a material in which an alkyl group, such as an aliphatic group or an aromatic group, is combined therewith as a side chain may be used for adjusting the film thickness and optical characteristics.

Next, the sol solution prepared as described above is applied to the front substrate 10 by using a die coating method or the like so as to cover the display electrode 11 and the black stripe 14. Thereafter, the coated sol-containing solution is left standing for a predetermined period of time (for example, for about 1 to 10 minutes under room temperature). Thus, the surface of the coated sol solution is leveled to form a flat surface. Thereafter, the solution is heated and dried at a temperature in a range of 50 to 300° C. for a predetermined period of time so that the sol is solidified by hydrolysis and condensation reactions to form a gel. Then, the gel is heated at a temperature in a range of 300 to 600° C. for a predetermined period of time so that the second dielectric layer 15*b* is formed.

Additionally, when the sol-containing solution is applied with a film thickness of about 10 to 300 μm, the second dielectric layer 15*b* having a film thickness of about 0.1 to 30 μm is formed. Therefore, in the case when a further larger film thickness is required for the second dielectric layer 15*b*, by repeating the coating process a plurality of times, it becomes possible to form the second dielectric layer 15*b* having a desired film thickness.

Additionally, as the film thickness of the dielectric layer 15 becomes smaller, the effect of improving PDP luminance and reducing power consumption becomes conspicuous. Therefore, as long as it is within a range that does not cause a reduction in dielectric strength voltage, the film thickness of the dielectric layer 15 is desirably made as thin as possible. For example, the film thickness of the dielectric layer 15 is desirably set to 50 μm or less. Moreover, the film thickness of the first dielectric layer 15*a* is desirably set to 5 μm to 30 μm, and the film thickness of the second dielectric layer 15*b* is desirably set to 5 μm to 30 μm.

The following description will discuss a desirable positional relationship among the first dielectric layer 15*a*, the second dielectric layer 15*b*, and the sealing member 17.

Usually, in order to prevent an erroneous discharge, the dielectric layer is disposed so as to completely cover the display electrodes located within a portion surrounded with the sealing member. Moreover, in order to ensure the adhesive strength between the front substrate and the sealing member, the sealing member is also injected between the mutually adjacent display electrodes so as to be directly made in contact with the front substrate. For this reason, usually, the sealing member and the dielectric layer are disposed so as to be made in contact with each other.

Upon forming the dielectric layer by using a sol-gel method, however, bubbles are generated on the contact face between the sealing member and the dielectric layer to sometimes cause a defective leakage. This is presumably because, when, upon forming the sealing member, the sealing glass frit to be formed into a sealing member is heated and fused, the alkyl group forming the side chain of the alkoxide contained in the sol-containing solution is heated and decomposed to generate a slight amount of gas.

The defective leakage can be suppressed by appropriately selecting the sol-containing solution and the material for the sealing member. However, there is a possibility that from the viewpoints of the film thickness, optical characteristics, and strength of the dielectric layer, the alkyl group serving as the side chain of the alkoxide has to be adjusted; therefore, another method for solving the defective leakage by using a method other than the material selection is required.

In the PDP 100 in accordance with the present embodiment, the defective leakage can be solved by optimizing the positional relationship among the first dielectric layer 15*a*, the second dielectric layer 15*b*, and the sealing member 17.

Figure 4A:
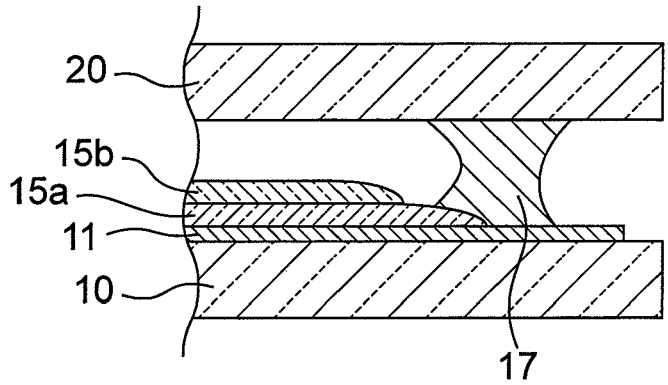
FIG. 4A is an enlarged cross-sectional view that shows a peripheral structure of the sealing member installed in the PDP in accordance with the embodiment of the present invention.
Figure 4B:
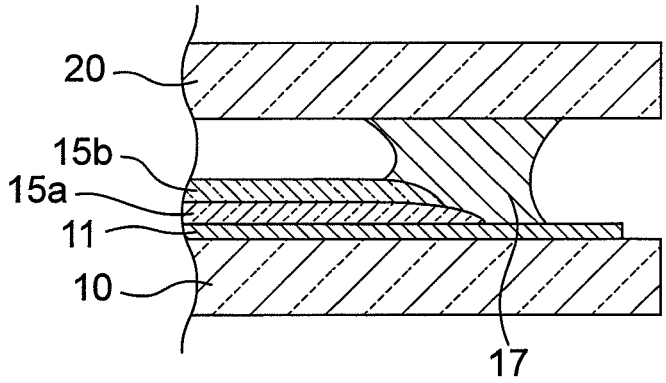
FIG. 4B is an enlarged cross-sectional view that shows a peripheral structure of the sealing member installed in the PDP in accordance with a first comparative example.
Figure 4C:
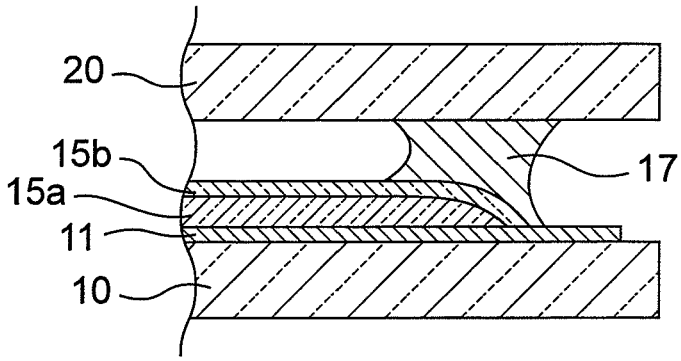
FIG. 4C is an enlarged cross-sectional view that shows a peripheral structure of the sealing member installed in the PDP in accordance with a second comparative example.

FIG. 4A is an enlarged cross-sectional view that shows a peripheral structure of the sealing member in the PDP in accordance with the embodiment of the present invention, FIG. 4B is an enlarged cross-sectional view that shows a peripheral structure of a sealing member in a PDP in accordance with a first comparative example, and FIG. 4C is an enlarged cross-sectional view that shows a peripheral structure of a sealing member in a PDP in accordance with a second comparative example. In FIGS. 4A to 4C, the positions of the front panel 1 and the back panel 2 are made upside down in a manner reversed to that of FIG. 1. Moreover, in FIGS. 4A to 4C, the dielectric-protection layer 16 is omitted.

In the PDP 100 in accordance with the present embodiment, as shown in FIG. 4A, the second dielectric layer 15*b* is formed so that the edge portion of the first dielectric layer 15*a* is exposed, and the sealing member 17 is formed so that the sealing member 17 is made in contact with the edge portion of the first dielectric layer 15*a*, without being made in contact with the second dielectric layer 15*b*. In the PDP in accordance with the first comparative example, as shown in FIG. 4B, the second dielectric layer 15*b* is formed so that the edge portion of the first dielectric layer 15*a* is exposed, and the sealing member 17 is formed so that the sealing member 17 is made in contact with both of the first and second dielectric layers 15*a* and 15*b*. In the PDP in accordance with the second comparative example, as shown in FIG. 4C, the second dielectric layer 15*b* is formed so as to cover the first dielectric layer 15*a*, and the sealing member 17 is formed so that the sealing member 17 is made in contact with the second dielectric layer 15*b*, without being made in contact with the first dielectric layer 15*a*.

Next, samples I to XII, which had any of the structures of the PDP in accordance with the present embodiment, the PDP in accordance with the first comparative example, and the PDP in accordance with the second comparative example, with the silicon-based alkoxide in the sol-containing solution to be used for forming the second dielectric layer and the glass component of the sealing glass frit to be used for forming the sealing member being altered, were manufactured, and the presence or absence of bubbles was confirmed. The following Table 1 shows the results. Moreover, two kinds of sol-containing solutions S1 and S2 having different silicon-based alkoxides were used, and two kinds of sealing glass frits G1 and G2 having different glass components were used.

TABLE 1

| Sample | Structure | Sol-containing solution | Sealing glass frit | Presence/absence of bubbles |
|---|---|---|---|---|
| I | PDP of first comparative example | S1 | G1 | Present |
| II | PDP of first comparative example | S1 | G2 | Present |
| III | PDP of first comparative example | S2 | G1 | Absent |
| IV | PDP of first comparative example | S2 | G2 | Present |
| V | PDP of second comparative example | S1 | G1 | Present |
| VI | PDP of second comparative example | S1 | G2 | Present |
| VII | PDP of second comparative example | S2 | G1 | Absent |
| VIII | PDP of second comparative example | S2 | G2 | Present |
| IX | PDP of the present embodiment | S1 | G1 | Absent |
| X | PDP of the present embodiment | S1 | G2 | Absent |
| XI | PDP of the present embodiment | S2 | G1 | Absent |
| XII | PDP of the present embodiment | S2 | G2 | Absent |

As shown in Table 1, in the PDP's of the first and second comparative examples having the structures of FIGS. 4B and 4C, bubbles were confirmed on the contact face between the sealing member and the dielectric layer in samples except for samples III and VII using the sol-containing solution S2 and the sealing glass frit G1. In contrast, in the PDP of the present embodiment having the structure of FIG. 4A, no bubbles were confirmed on the contact face between the sealing member and the dielectric layer in all the samples IV to XII. That is, in the PDP of the present embodiment having the structure of FIG. 4A, even when materials that might cause bubbles in the sol-containing solution and the sealing glass frit were used, the generation of bubbles was suppressed. Therefore, it was confirmed that, by disposing the first dielectric layer 15*a*, the second dielectric layer 15*b* and the sealing member 17 as shown in FIG. 4A, a defective leakage can be prevented.

As the sol-containing solution, those having a comparatively low viscosity in a level of several Pa·s to several tens of Pa·s are usually used. In this case, depending on flows of the coated sol-containing solution, the film thickness of the end portion of the dielectric layer might become uneven. The unevenness of the film thickness of the end portion of the dielectric layer causes the squashed state of the sealing member to become uneven, resulting in the possibility of deviations in the gap between the front panel and the back panel. In contrast, in accordance with the PDP 100 of the present embodiment, since the second dielectric layer 15*b* to be formed by the sol-gel method is prevented from being made in contact with the sealing member 17, no adverse effects are given to the squashed state of the sealing member 17. Therefore, it is possible to prevent the occurrence of deviations in the gap between the front panel 1 and the back panel 2.

The following description will discuss the results of evaluations carried out to confirm the crack suppressing effect and the power consumption suppressing effect of the PDP 100 in accordance with the present embodiment.

In this case, three samples in which the first and second dielectric layers were made by using different methods were prepared.

First sample: The first dielectric layer was made by using a firing method so as to have a film thickness of 11 to 12 μm, and the second dielectric layer was made by using the firing method so as to have a film thickness of 27 to 28 μm.

Second sample (structure of the present embodiment): The first dielectric layer was made by using a firing method so as to have a film thickness of 11 to 12 μm, and the second dielectric layer was made by a sol-gel method so as to have a film thickness of 8 to 12 μm.

Third sample: The first dielectric layer was made by using a sol-gel method so as to have a film thickness of 11 to 12 μm. No second dielectric layer was formed.

In this case, as the sol-containing solution used for the sol-gel method, a solution, prepared by diluting an alkoxide with a methyl group attached as a side chain by using an alcohol-based solvent, with silicon oxide particles of 30 to 80 nm being contained therein at a volume ratio of 50 to 70% and uniformly dispersed, was used.

The size of the discharge cell was set to 480 μm×480 μm, the width of the bus electrode was set to 70 to 90 μm and the film thickness of the bus electrode was set to 4 to 6 μm.

Table 2 shows the dielectric constant, the film thickness, the rate of generation of cracks (rate of the number of panels in which cracks generated to the number of all the panels manufactured), and the reactive power (ratio relative to the reactive power in the first sample defined as 100%) of each of the samples.

TABLE 2

| | First dielectric layer | | | Second dielectric layer | | | | |
|---|---|---|---|---|---|---|---|---|
| | Formation method | Dielectric constant ε | Film thickness (μm) | Formation method | Dielectric constant ε | Film thickness (μm) | Rate of generation of cracks | Reactive power (W) <ratio> |
| First sample | Firing method | 10 to 12 | 11 to 12 | Firing method | 10 to 12 | 27 to 28 | 1% or less | 100% |
| Second sample | Firing method | 10 to 12 | 11 to 12 | Sol-gel method | 3 to 4 | 9 to 10 | 1% or less | 50 to 70% |
| Third sample | Sol-gel method | 3 to 4 | 11 to 12 | — | — | — | about 90% | 50 to 70% |

In Table 2, the dielectric constant was found in the following manner.

First, after forming a dielectric layer on a glass substrate with ITO (indium-tin oxide) applied thereto so as to have a predetermined film thickness by using a glass frit-containing material through a firing method, a thin-film electrode with a predetermined area was formed on the dielectric layer by using a vapor deposition method. Moreover, after forming a dielectric layer on the glass substrate with ITO applied thereto so as to have a predetermined film thickness by using a sol-containing solution through a sol-gel method, a thin-film electrode was formed on the dielectric layer by using a vapor deposition method.

Next, the electrostatic capacity between the ITO and the thin-film electrode, that is, in the thickness direction of the dielectric layer, was measured by an LCR meter (made by Hewlett-Packard Development Company).

Next, the dielectric constant was calculated by the following calculation method.

$$\in = C \cdot d / (\in_0 \cdot S)$$

$\in$: Dielectric constant of the dielectric member
C: Electrostatic capacity measured
d: Film thickness of the dielectric layer
$\in_0$: Dielectric constant of vacuum
S: Area of the electrode Measurements of the film thicknesses of the first and second dielectric layers 15*a* and 15*b* were carried out by cutting off one portion of each of the first and second dielectric layers 15*a* and 15*b* of the finished front panel 1 and by measuring the resulting difference in height between each of the first and second dielectric layers 15*a* and 15*b* and the front substrate 10, by the use of a contact-type step height meter (made by TENCOR Corp.).

First, the following description will discuss the crack.

As indicated by Table 2, in the third sample on which the dielectric layer was formed by using only the sol-gel method, the rate of generation of cracks was about 90%, which was greatly high. Also, the cracks generated on the entire dielectric layer. This is presumably because, in the case when the dielectric layer was formed by using only the sol-gel method, since the film thickness of the dielectric layer became smaller, cracks generated with high probability due to fine foreign matters. In order to suppress these cracks, it would be effective to provide a further cleaner production environment so as to prevent fine foreign matters from entering and also to improve crack resistant characteristics of the materials to be used. However, this attempt might cause the manufacturing costs and material costs to increase.

In contrast, in the first sample in which the dielectric layer was formed by using only the firing method and the second sample having the dielectric structure of the present embodiment in which the first dielectric layer was formed by using the firing method, with the second dielectric layer being formed by using the sol-gel method, the rate of generation of cracks was reduced to 1% or less, which was considered to be virtually zero. Moreover, the portion in which cracks generated was limited only to a small portion.

The following description will discuss the power consumption.

Usually, the power consumption of the PDP is represented by a sum of discharge power required for discharging to provide a light-on state and reactive power that is required depending on the capacitance between electrodes and is not related to the light-on state. Here, the reactive power was found as the product of a voltage and a current in the case when a voltage having the same waveform as that used for providing the light-on state by using a generally used driving circuit is applied only to the display electrodes of the front panel (that is, in the case when the entire surface of the PDP is set to a black display screen (non-light-on state)).

As indicated by Table 2, in the case when the reactive power of the first sample on which the dielectric layer has been formed by using only the firing method is defined as 100%, the reactive power of the third sample with the dielectric layer formed by using only the sol-gel method and the reactive power of the second sample having the dielectric structure of the present embodiment were 50 to 70%. That is, it was found that by using the second sample and the third sample, the reactive power can be reduced by 30 to 50% in comparison with that of the first sample.

As described above, by adopting the dielectric structure of the present embodiment, it becomes possible to suppress the generation of cracks in the dielectric layer and also to reduce the reactive power and consequently to reduce the power consumption. Moreover, since the second dielectric layer is not a porous layer like that of the dielectric structure of Patent Document 1, there is no possibility of a reduction in the adhesive property and strength as well as luminance irregularities in the PDP.

Moreover, by forming the first dielectric layer using the firing method and forming the second dielectric layer using the sol-gel method as in the case of the present embodiment, it becomes possible to expect the effect of improving the adhesive property between the first dielectric layer and the second dielectric layer. That is, in the case of forming the first dielectric layer by using a glass-frit-containing material through the firing method, although the glass frit is fused, a concave/convex pattern is formed on the surface of the first dielectric layer by the trace of its shape. This concave/convex pattern on the surface of the first dielectric layer presumably provides an anchor effect upon forming the second dielectric layer to improve the adhesive strength between the first dielectric layer and the second dielectric layer. Therefore, by adopting the dielectric structure of the present embodiment, it becomes possible to improve the yield.

Since the plasma display panel of the present invention and its manufacturing method make it possible to prevent the generation of cracks in the dielectric layer and also to improve the yield, they are effectively used for a plasma display panel that calls for low power consumption, and the manufacturing method thereof.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

The disclosure of Japanese Patent Application No. 2008-307180 filed on Dec. 2, 2008 including specification, drawing and claims are incorporated herein by reference in its entirety.

The invention claimed is:

1. A method for manufacturing a plasma display panel, the plasma display panel including a front panel and a back panel arranged so as to be opposed to each other with a discharge space formed therebetween, the front panel having a front substrate, an adhesive sealing member disposed on a non-image display area on a peripheral portion of the space so as to seal the space, display electrodes formed on the front substrate in a stripe pattern, a first dielectric layer containing low-melting-point glass having a softening point in a range of 400° C. or more to 600° C. or less, and a second dielectric layer having a structure with a siloxane skeleton, said method comprising:

forming the first dielectric layer on the front substrate;

forming the second dielectric layer on the first dielectric layer by using a sol-gel method so as to allow an edge portion of the first dielectric layer to be exposed on a plan view; and forming the adhesive sealing member so as to be in contact with the front substrate and the edge portion of the first dielectric layer, and so as not to be in contact with the second dielectric layer, wherein said forming of the first dielectric layer includes printing or applying a dielectric paste containing a glass frit onto the front substrate so as to cover the display electrodes, drying the printed or applied dielectric paste, and firing the dried dielectric paste at a temperature not less than a softening point of the glass frit.

2. A plasma display panel comprising:

a front panel and a back panel arranged so as to be opposed to each other with a discharge space formed therebetween, the front panel having a front substrate;

an adhesive sealing member disposed on a non-image display area on a peripheral portion of the space so as to seal the space;

display electrodes formed on the front substrate in a stripe pattern;

a first dielectric layer formed on the front substrate so as to cover the display electrodes, and the first dielectric layer containing low-melting-point glass having a softening point in a range of 400° C. or more to 600° C. or less; and a second dielectric layer formed on the first dielectric layer so as to allow an edge portion of the first dielectric layer to be exposed on a plan view, the second dielectric layer having a structure with a siloxane skeleton, wherein the adhesive sealing member is formed so as to be in contact with the front substrate and the edge portion of the first dielectric layer, and so as not to be in contact with the second dielectric layer.

* * * * *